US011047399B2

(12) United States Patent
Arikawa

(10) Patent No.: US 11,047,399 B2
(45) Date of Patent: Jun. 29, 2021

(54) ACCUMULATOR

(71) Applicant: Eagle Industry Co., Ltd., Tokyo (JP)

(72) Inventor: Tatsuhiro Arikawa, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 16/605,777

(22) PCT Filed: Apr. 27, 2018

(86) PCT No.: PCT/JP2018/017126
§ 371 (c)(1),
(2) Date: Oct. 16, 2019

(87) PCT Pub. No.: WO2018/207654
PCT Pub. Date: Nov. 15, 2018

(65) Prior Publication Data

US 2020/0158144 A1 May 21, 2020

(30) Foreign Application Priority Data

May 11, 2017 (JP) ..... JP2017-094401

(51) Int. Cl.
*F15B 1/14* (2006.01)
*F15B 15/14* (2006.01)

(52) U.S. Cl.
CPC ..... *F15B 1/14* (2013.01); *F15B 15/14* (2013.01)

(58) Field of Classification Search
CPC ..... F15B 1/14; F15B 15/14; F15B 2201/405; F15B 2201/4056
See application file for complete search history.

(56) References Cited

U.S. PATENT DOCUMENTS 2,365,994 A * 12/1944 Ashton ..... F15B 1/103 138/31
2,561,957 A 7/1951 Teague ..... 60/54.6
3,336,948 A 8/1967 Lucien ..... 138/31
3,776,267 A * 12/1973 Alley ..... G01L 7/065 137/494

(Continued)

FOREIGN PATENT DOCUMENTS

CN 1888453 1/2007 ..... F15B 1/24
CN 101821514 9/2010 ..... F15B 1/08

(Continued)

OTHER PUBLICATIONS

International Search Report (w/translation) Written Opinion (w/machine translation) issued in application No. PCT/JP2018/017126, dated Aug. 7, 2018 (10 pgs).

(Continued)

*Primary Examiner* — Thomas E Lazo
(74) *Attorney, Agent, or Firm* — Hayes Soloway P.C.

(57) ABSTRACT

Provided is an accumulator for easier maintenance of a metal bellows. The accumulator includes a housing having a shell provided with an opening portion and a disk-shaped base body to which one end of a metal bellows with an outside diameter smaller than the inside diameter of the opening portion is welded and fixed, the interior of the housing partitioned on the inside and outside of the metal bellows in a tightly closed manner, in which the base body is formed to have an outside diameter greater than the outside diameter of the metal bellows, and the base body is fixed detachably to the shell.

17 Claims, 8 Drawing Sheets

(56) References Cited

U.S. PATENT DOCUMENTS

| | | | | |
|---|---|---|---|---|
| 7,325,571 | B2 * | 2/2008 | Shimbori | F15B 1/106 138/30 |
| 7,770,599 | B2 * | 8/2010 | Ota | F15B 1/103 138/31 |
| 8,096,324 | B2 * | 1/2012 | Nakaoka | F15B 1/103 138/31 |
| 9,027,600 | B2 * | 5/2015 | Yamashita | F15B 20/007 138/31 |
| 2005/0061379 | A1 * | 3/2005 | Mori | F16L 55/053 138/31 |
| 2009/0101222 | A1 | 4/2009 | Baltes et al. | 138/30 |

FOREIGN PATENT DOCUMENTS

| | | | |
|---|---|---|---|
| JP | S49100472 | 9/1974 | F16J 15/36 |
| JP | S5798396 | 6/1982 | F15B 1/04 |
| JP | H0932801 | 2/1997 | F15B 1/02 |
| JP | 2010174985 | 8/2010 | F15B 1/08 |
| JP | 2011-226557 | 11/2011 | F15B 1/08 |
| JP | 2016-9667 | 1/2016 | H01M 2/34 |

OTHER PUBLICATIONS

International Preliminary Report on Patentability issued in application No. PCT/JP2018/017126, dated Nov. 21, 2019 (7 pgs).
Chinese Official Action issued in related Chinese Patent Application Serial No. 201880030113.2 with translation (12 pages).
Extended European Search Report issued in EPO Patent Appln. 18799120.3-1010, dated Jan. 11, 2021, 8 pages.
Chinese Official Action issued in Chinese Patent Appln. 201880030113.2, dated Mar. 2, 2021, 10 pages.

* cited by examiner

ACCUMULATOR

TECHNICAL FIELD

The present invention relates to a metal bellows-type accumulator used as a pressure accumulator, a pulsation damper, and the like in, for example, automobile hydraulic systems and industrial equipment hydraulic systems.

BACKGROUND ART

An accumulator for pressure accumulation, pulsation damping (or buffering), and the like is provided in a hydraulic circuit of a hydraulic controller in, for example, automobiles and industrial equipment. Such an accumulator has a housing and a bellows arranged in the housing, the bellows comprising a metal bellows main body with a fixed end welded and fixed to the housing and a bellows cap mounted to the other end of the bellows main body. The bellows main body and the bellows cap cooperatively partition the interior space of the housing into a gas chamber for gas enclosure and a liquid chamber in communication with a fluid outflow and inflow path to be connected to the hydraulic circuit in a tightly closed manner. The bellows is also configured to operate in a pressure accumulating manner, a pulsation damping manner, and the like in which the bellows main body expands and contracts such that the gas pressure within the gas chamber and the liquid pressure within the liquid chamber are balanced upon receiving liquid flowing from the hydraulic circuit through the fluid outflow and inflow path into the liquid chamber.

In the accumulator disclosed in Patent Citation 1, a bellows mechanism is arranged within a housing consisting of a lid body and an outer shell member, and one end of a metal bellows of the bellows mechanism is welded and fixed to the interior surface portion of the metal lid body, which is provided with a fluid outflow and inflow path. An outer peripheral portion of the lid body is also welded and fixed, with the metal bellows being welded and fixed thereto, to a curved portion formed in an opening portion of the metal outer shell member, and the opening portion of the outer shell member is closed by the lid body, such that the bellows mechanism partitions the interior space of the housing into a gas chamber and a liquid chamber in a tightly closed manner.

CITATION LIST

Patent Literature

Patent Citation 1: JP 2010-174985 A (Page 3, FIG. 1)

SUMMARY OF INVENTION

Technical Problem

However, in Patent Citation 1, since the lid body, to which one end of the metal bellows of the bellows mechanism is welded and fixed, is welded and fixed to close the opening portion of the outer shell member with being pressed against the outer shell member, not only the operation of fixation is cumbersome, but also the lid body and the outer shell member cannot be separated easily. This means that there is a problem that it is difficult to maintain the bellows mechanism arranged within the housing.

The present invention has been made in view of the above-described problem, and an object thereof is to provide an accumulator for easier maintenance of a metal bellows.

Solution to Problem

In order to solve the foregoing problems, an accumulator according to a first aspect of the present invention includes a housing having a shell provided with an opening portion and a base body formed in a disk shape, a bellows made of metal and having an outer diameter smaller than an inner diameter of the opening portion. One end portion of the bellows is welded and fixed to the base body. An interior of the housing is partitioned into an inner space and an outer space of the bellows in a tightly closed manner. The base body has an outer diameter greater than the outer diameter of the bellows, and the base body is fixed detachably to the shell.

According to the first aspect, since the opening portion of the shell is formed to have an inner diameter smaller than the outer diameter of the bellows and the base body is formed to have an outer diameter greater than the outer diameter of the bellows, the bellows and the base body can be mounted to the shell by inserting the bellows welded and fixed to the base body through the opening portion of the shell and fixing the base body detachably to the shell, and further the bellows and the base body can be drawn and detached together through the opening portion of the shell for easier maintenance of the metal bellows.

In the accumulator according to a second aspect of the present invention, an inner peripheral surface of the shell is provided with a restrictive stepped portion with which an outer peripheral portion of the base body is in contact.

According to the second aspect, the outer peripheral portion of the base body comes into contact with the restrictive stepped portion provided in the inner peripheral surface of the shell, whereby the movement of the base body in the direction of insertion within the shell can be restricted and thereby the base body can be positioned easily with respect to the shell.

The accumulator according to a third aspect of the present invention further including an annular seal member provided between the outer peripheral portion of the base body and the inner peripheral surface of the shell, and a fixing member formed as a discrete body separate from the base body and configured to fix the base body to the shell.

According to the third aspect, when the base body is mounted to the shell, the annular seal member can be interposed between the outer peripheral portion of the base body and the inner peripheral surface of the shell, which can prevent fluid within the housing from leaking out. In addition, the fixing member formed as a discrete body separate from the base body can provide fixation with the outer peripheral portion of the base body in contact with and positioned with respect to the restrictive stepped portion provided in the inner peripheral surface of the shell, whereby the base body can be fixed in a predetermined position to the shell. That is, with this arrangement, the sealing function and the fixing function are adjusted independently and therefore can be fulfilled reliably without welding.

In the accumulator according to a fourth aspect of the present invention, the fixing member has an outer peripheral portion provided with a male screw portion screwed into a female threaded portion provided in the inner peripheral surface of the shell.

According to the fourth aspect, the base body can be fixed easily to the shell with the fixing member by screwing the male screw portion provided on the outer peripheral portion of the fixing member into the female threaded portion provided in the inner peripheral surface of the shell.

In the accumulator according to a fifth aspect of the present invention, the fixing member is annular.

According to the fifth aspect, since the fixing member is annular, the base body can be fixed evenly to the shell and the total weight can be reduced.

In the accumulator according to a sixth aspect of the present invention, the base body is provided with a through hole in communication with the inner space of the bellows.

According to the sixth aspect, since fluid can flow into or out of the inner space of the bellows through the through hole provided in the base body, the base body can be used as an oil port or a gas port.

In the accumulator according to a seventh aspect of the present invention, the base body is key-fitted into the shell.

According to the seventh aspect, the base body is key-fitted into the shell, whereby the base body can be prevented from being rotated with respect to the shell, which prevents the annular seal member from being rotated, even when the fixing member is screwed and thereby the base body is fixed to the shell, and allows a sealing performance of the annular seal member to be ensured.

DESCRIPTION OF EMBODIMENTS

Modes for carrying out an accumulator according to the present invention will hereinafter be described based on the following embodiments.

First Embodiment

The first embodiment of the accumulator according to the present invention will be described with, reference to FIGS. 1 to 3. The following description is based on the vertical and horizontal directions when viewed on the frontal side (front side) of the accumulator, which is on the near side of the plane of paper of FIG. 1.

The accumulator 1 is used as a pressure accumulator, a pulsation damper, and the like in, for example, automobile hydraulic systems and industrial equipment hydraulic systems, being a metal bellows-type accumulator in which a metal bellows is used as a bellows main body 31.

Figure 1:
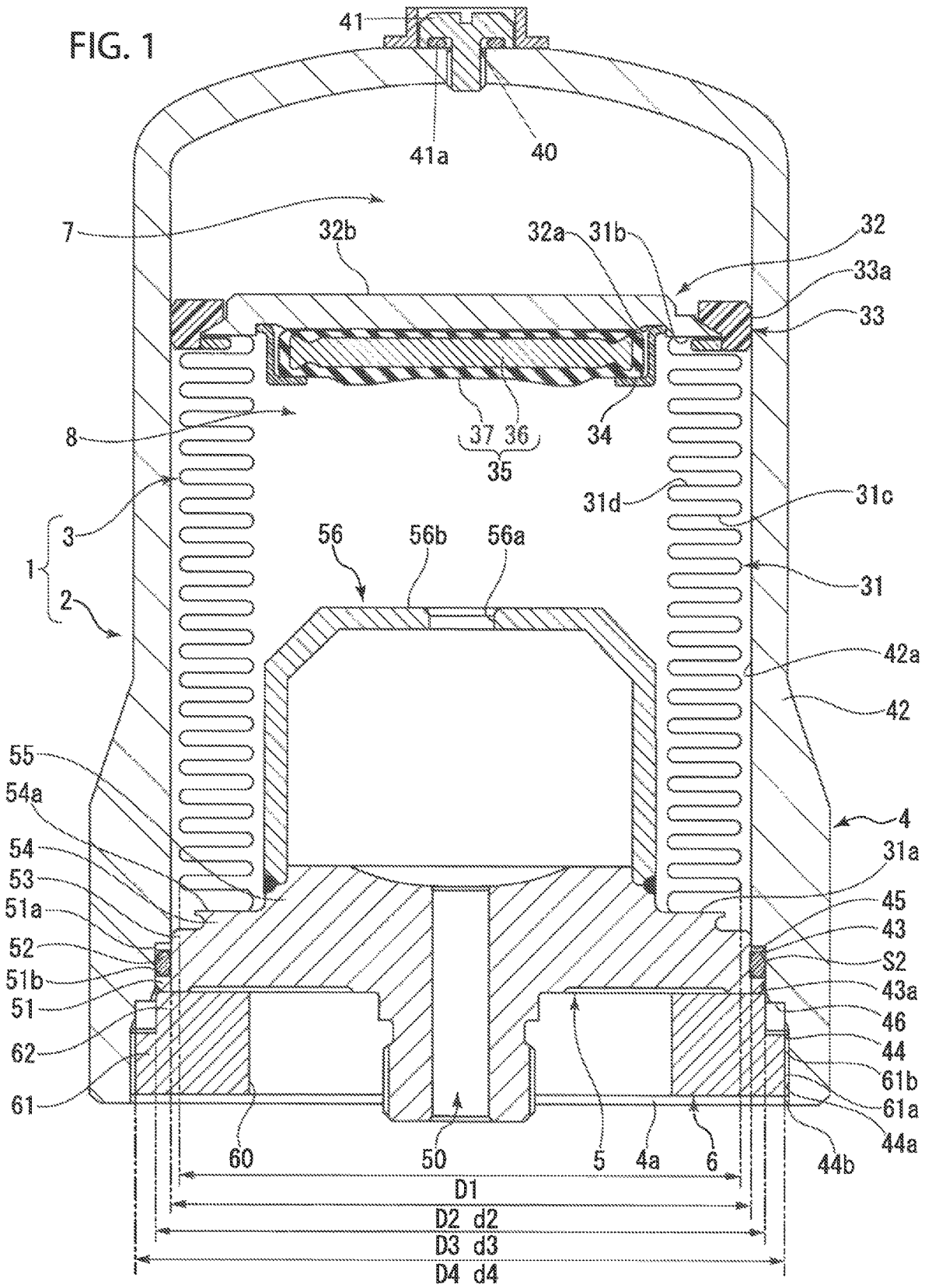
FIG. 1 is a cross-sectional view showing a first embodiment of the accumulator according to the present invention.

As shown in FIG. 1, the accumulator 1 includes a housing 2 and a bellows 3 provided within the housing 2. It is noted that FIG. 1 shows a state where the bellows main body 31 to be described hereinafter expands due to a pressure by, for example, liquid accumulation.

The structure of the bellows 3 will first be described, in detail. As shown in FIGS. 1 and 2, the bellows 3 includes the metal bellows main body 31 having an approximately cylindrical shape with the upper and lower ends thereof opened and a disk-shaped metal bellows cap 32. It is noted that the bellows main body 31 is formed to have an outer diameter D1 smaller than the inner diameter d2 on the upper end side of a cylindrical portion 42 of a shell 4 and the inner diameter d4 of an opening portion 4*a* of the shell 4 to be described hereinafter (D1<d2, d4; see FIG. 1).

The bellows main body 31 is welded and fixed to the interior surface portion (particularly corresponding to a welded portion 54*a* of a second annular convex portion 54) of an oil port member 5 (also referred to as a base body) to be described hereinafter so that a fixed end 31*a* forming the lower end is closed, while a lower surface 32*a* of the bellows cap 32 is welded and fixed, with an annular protection ring 33 sandwiched therebetween to close a freely movable end 31*b* forming the upper end.

It is noted that the protection ring 33 protects the bellows main body 31 not to come into direct contact with the inner peripheral surface 42*a* on the upper end side of the cylindrical portion 42 of the shell 4, in which the outer peripheral surface 33*a* of the protection ring 33 and the inner peripheral surface 42*a* of the cylindrical portion 42 of the shell 4 are separated slightly in the radial direction for smooth sliding without interference with the expanding and contracting operation of the bellows 3.

In addition, an annular seal holder 34 having a crank shape in cross-sectional view is fitted in the lower surface 32*a* of the bellows cap 32, and a disk-shaped seal member 35 is attached and fixed to the seal holder 34.

The seal member 35 is formed through adherence (e.g. vulcanizing adhesion) of a rubber elastic body 37 to part or all of the surface of a disk-shaped metal base material 36.

The structure of the housing 2 will next be described in detail. As shown in FIGS. 1 and 2, the housing 2 is constituted by the bottomed cylindrical shell 4 having the opening portion 4*a* at the lower end and the oil port member 5 for sealing the opening portion 4*a* of the shell 4. It is noted that the oil port member 5 is fixed, while sealing the opening portion 4*a* of the shell 4, to the shell 4 with a separate fixing member 6.

A gas enclosure port 40 for injecting high-pressure gas (e.g. nitrogen gas) therethrough into a gas chamber 7 to be described hereinafter formed within the housing 2 is provided at an approximately radially central position of an upper end portion of the shell 4. It is noted that the gas enclosure port 40 is closed with a gas plug 41 screwed and fixed therein after injection of high-pressure gas. Upon this, an O-ring 41*a* composed of a rubber elastic body and interposed between the gas plug 41 and the shell 4 can prevent high-pressure gas within the gas chamber 7 of the housing 2 from leaking out.

Further, the cylindrical portion 42 of the shell 4 is configured such that the opening portion 4*a* is thickened radially outward, a first annular recessed portion 43 to which the oil port member 5 is mounted is formed in the inner peripheral surface 43*a* closer to the opening portion 4*a* than the inner peripheral surface 42*a* on the upper end side of the cylindrical portion 42, and a second annular recessed portion 44 to which the fixing member 6 is mounted is formed in the inner peripheral surface 44*a* closer to the opening portion 4*a* than the first annular recessed portion 43 (or the inner peripheral surface 43*a*).

The first annular recessed portion 43 is formed to have an inside diameter d3 greater than the inner diameter d2 of the inner peripheral surface 42*a* on the upper end side of the cylindrical portion 42 of the shell 4 (against which the outer peripheral surface 33*a* of the protection ring 33 of the above-described bellows 3 slides) (d2<d3; see FIG. 1). This causes a radially annular face portion to be formed between an end portion on the opening portion 4*a* side of the inner peripheral surface 42*a* of the cylindrical portion 42 of the shell 4 and an end portion on the upper end side of the first annular recessed portion 43 (or the inner peripheral surface 43*a*) due to the dimensional difference between the inner diameter d2 of the inner peripheral surface 42*a* on the upper end side of the cylindrical portion 42 and the inner diameter d3 of the first annular recessed portion 43, whereby an approximately right-angled first annular stepped portion 45 (restrictive stepped portion) is formed in the cylindrical portion 42 of the shell 4.

The second annular recessed portion 44 is formed to have an inside diameter d4 greater than the inside diameter d3 of the first annular recessed portion 43 (d3<d4; see FIG. 1). It is noted that the inner diameter d4 of the second annular recessed portion 44 is approximately equal to the inner diameter d4 of the opening portion 4*a* of the shell 4. This causes a radially annular face portion to be formed between an end portion on the opening portion 4*a* side of the first annular recessed portion 43 (or the inner peripheral surface 43*a*) of the cylindrical portion 42 of the shell 4 and an end portion on the upper end side of the second annular recessed portion 44 (or the inner peripheral surface 44*a*) due to the dimensional difference between the inner diameter d3 of the first annular recessed portion 43 and the inner diameter d4 of the second annular recessed portion 44, whereby an approximately right-angled second annular stepped portion 46 is formed in the cylindrical portion 42 of the shell 4. The second annular recessed portion 44 is also formed with a female threaded portion 44*b* into which a male screw portion 61*b* formed on the fixing member 6 to be described hereinafter is screwed.

The oil port member 5 is provided with a fluid outflow and inflow path 50 (also referred to as a through hole) penetrating in the axial direction thereof within the housing 2 through which liquid (e.g. hydraulic oil) flows out of and into pressure piping not shown.

The oil port member 5 is also provided with an annular mounting portion 51 with an outer diameter D3 approximately equal to the inner diameter d3 of the first annular recessed portion 43 formed in the cylindrical portion 42 of the shell 4, and an O-ring 52 (also referred to as an annular seal member) composed of a rubber elastic body is mounted in an annular groove portion 51*b* formed in the outer peripheral surface 51*a* of the mounting portion 51 and recessed radially inward. It is noted that the mounting portion 51 is formed to have an outer diameter D3 greater than the outer diameter D1 of the bellows main body 31 (D1<D3; see FIG. 1).

The interior surface (i.e. an upper surface) of the oil port member 5 is also formed with a first annular convex portion 53 protruding upward (toward the interior of the housing 2) from the mounting portion 51 and having an outer diameter D2 approximately equal to the inner diameter d2 of the inner peripheral surface 42*a* on the upper end side of the cylindrical portion 42 of the shell 4, and a second annular convex portion 54 protruding upward is formed on the radially inside of the first annular convex portion 53, to which the fixed end 31*a* of the above-described bellows main body 31 is welded and fixed. Further, a third annular convex portion 55 protruding upward is formed on the radially inside of the second annular convex portion 54, and a stay 56 having an approximately inverse U shape in cross-sectional view is welded and fixed on the radially outside.

A through hole 56*a* penetrating in the axial direction is provided at an approximately radially central position of an upper end portion of the stay 56, and an annular seal surface 56*b* is formed on the radially outside of the through hole 56*a*.

The interior space of the housing 2 has a structure partitioned by the bellows 3 (including bellows main body 31 and bellows cap 32) into a gas chamber 7 in communication with the gas enclosure port 40 and a liquid chamber 8 in communication with the fluid outflow and inflow path 50 in a tightly closed manner.

The gas chamber 7 is defined by the inner peripheral surface 42*a* of the shell 4, the outer peripheral surface 31*c* of the bellows main body 31, and the upper surface 32*b* of the bellows cap 32 to enclose high-pressure gas injected through the gas enclosure port 40.

The liquid chamber 8 is defined by the stay 56, the inner peripheral surface 31*d* of the bellows main body 31, and the lower surface 32*a* of the bellows cap 32 (seal holder 34, seal member 35), out of and into which liquid is to flow from the pressure piping through the fluid outflow and inflow path 50.

The accumulator 1 performs pressure regulation through expanding and extracting operations of the bellows 3 provided within the housing 2 to move the bellows cap 32 to a predetermined position for balancing between the gas pressure within the gas chamber 7 and the liquid pressure within the liquid chamber 8.

Figure 2:
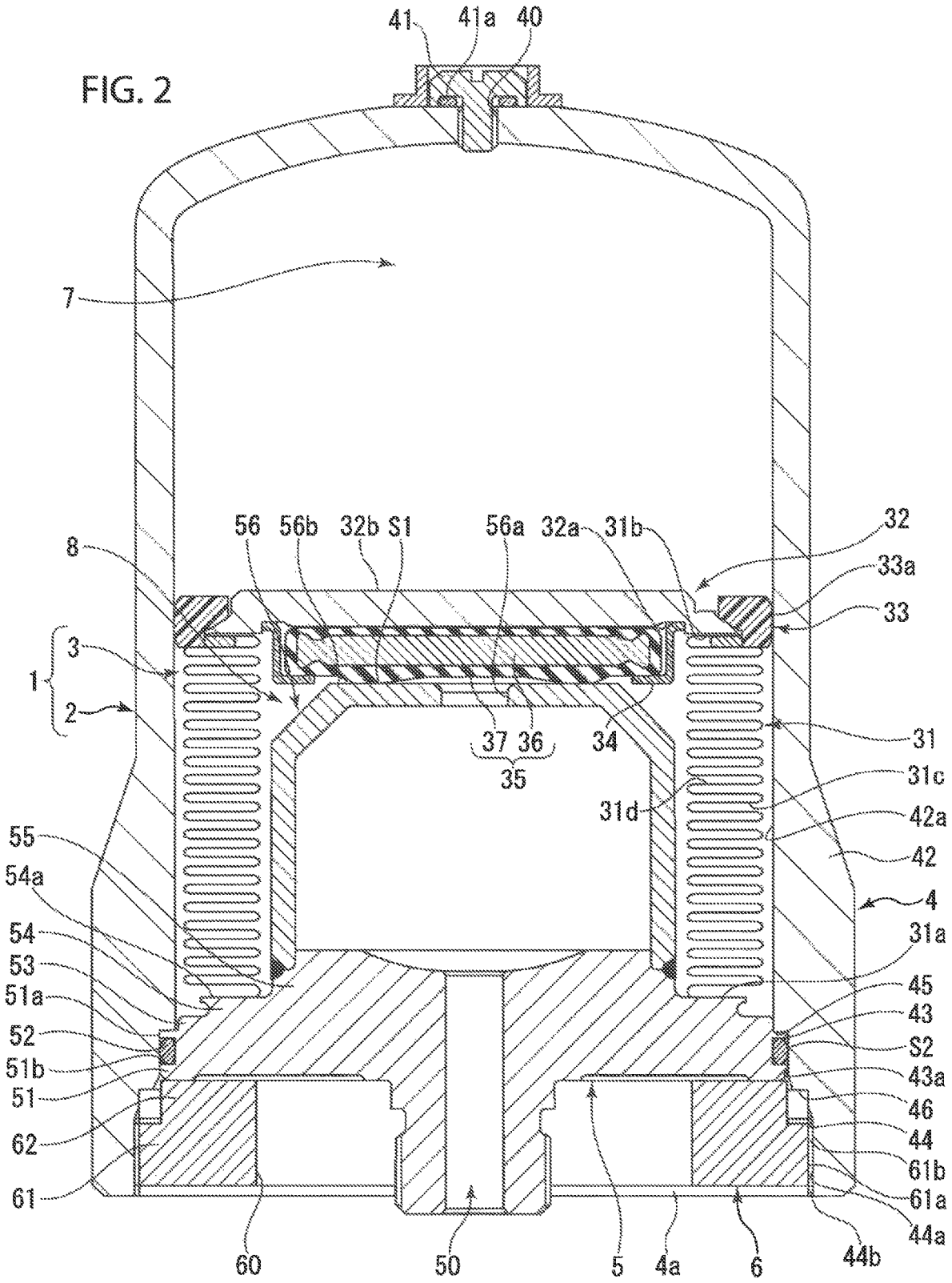
FIG. 2 is a cross-sectional view showing a state where a seal member and a seal surface of the accumulator shown in FIG. 1 are in close contact with each other.
Figure 3:
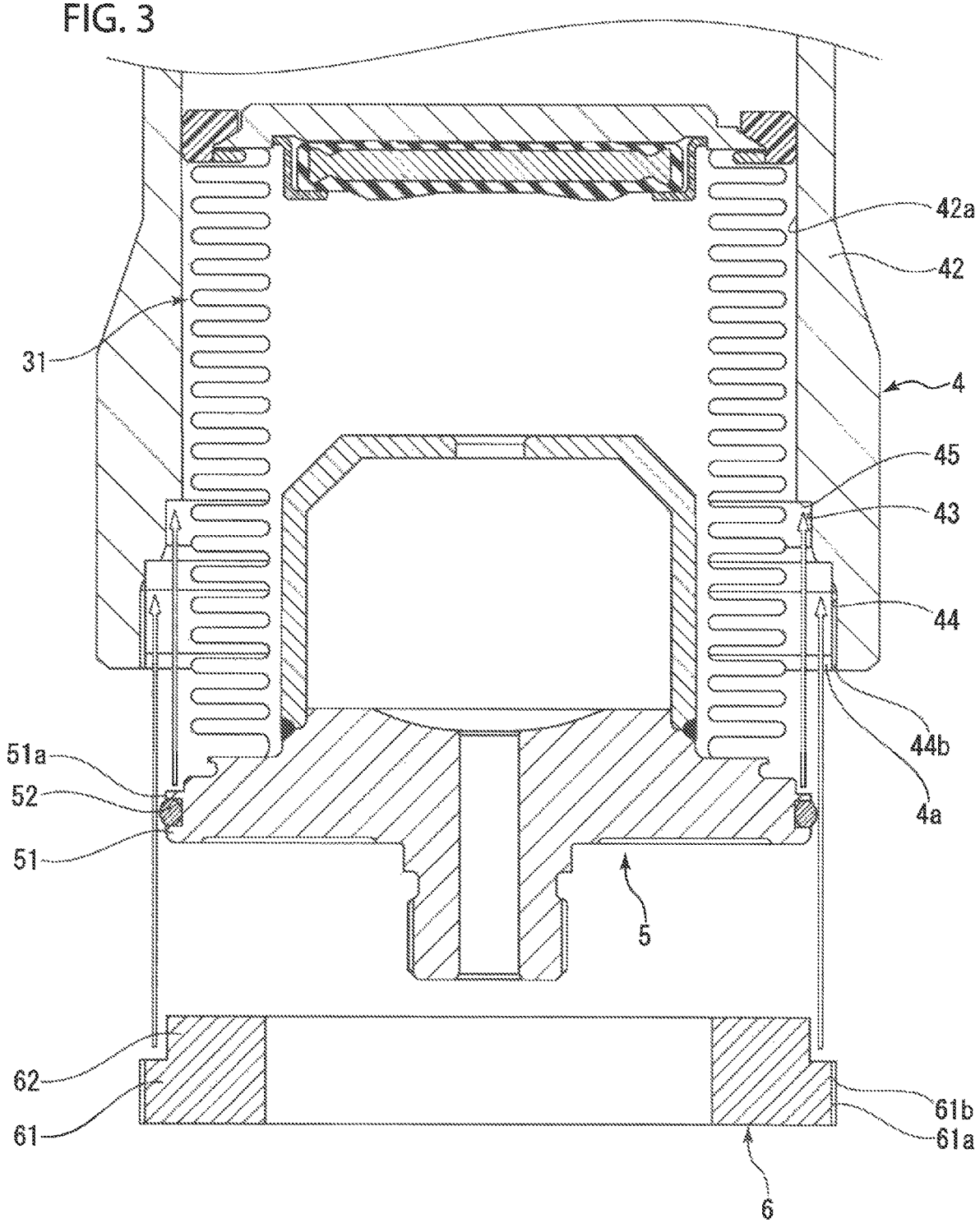
FIG. 3 is a cross-sectional view showing a method of fixation of an oil port member to a shell using a fixing member in the first embodiment.

For example, as shown in FIG. 2, when liquid within the pressure piping is discharged, the bellows cap 32 moves downward under the gas pressure within the gas chamber 7 and thus the bellows main body 31 contracts, whereby the seal member 35 attached to the lower surface 32*a* of the bellows cap 32 and the seal surface 56*b* of the stay 56 come into close contact with each other to form an annular seal portion S1 (see FIG. 2) and close the through hole 56*a* of the stay 56. This causes part of the liquid to be confined within the liquid chamber 8 and the pressure of the confined liquid and the gas pressure within the gas chamber 7 to be balanced, whereby the bellows main body 31 cannot be subject to an excessive stress and can be less likely to be damaged.

The structure of the fixing member 6 will next be described in detail. As shown in FIGS. 1 and 2, the fixing member 6 has an annular configuration with a through hole 60 penetrating in the axial direction provided on the radially inside, and a male screw portion 61*b* is formed on the outer peripheral surface 61*a* of the mounting portion 61 formed to have an outer diameter D4 approximately equal to the inner diameter d4 of the second annular recessed portion 44 that is formed in the cylindrical portion 42 of the shell 4. It is noted that the tip of the mountain of the male screw portion 61*b* formed on the fixing member 6 is formed to have an outer diameter approximately equal to the inner diameter at the bottom of the valley of the female threaded portion 44*b* of the second annular recessed portion 44 formed in the cylindrical portion 42 of the shell 4.

Also, on the upper surface of the fixing member 6 is formed an annular convex portion 62 protruding upward (toward the oil port member 5) from the mounting portion 61 and formed to have an outer diameter D3 approximately equal to the inner diameter d3 of the first annular recessed portion 43 formed in the cylindrical portion 42 of the shell 4.

There will be described in detail a method for fixing the oil port member 5 to the shell 4 with the fixing member 6. As shown in FIG. 3, the oil port member 5 with the fixed end 31*a* of the bellows main body 31 welded and fixed thereto is first inserted through the opening portion 4*a* of the shell 4 so that the bellows main body 31 is arranged within the shell 4. Specifically, the interior surface (i.e. the upper surface) of the mounting portion 51 of the oil port member 5 is brought into contact with the first annular stepped portion 45 formed in the cylindrical portion 42 of the shell 4 and fitted into the first annular recessed portion 43, so that the oil port member 5 is positioned axially with respect to the shell 4. Upon this, the O-ring 52 is interposed between the outer peripheral surface 51*a* of the mounting portion 51 of the oil port member 5 and the first annular recessed portion 43 to form an annular seal portion S2 (see FIGS. 1 and 2).

Next, the male screw portion 61*b* formed on the outer peripheral surface 61*a* of the mounting portion 61 of the fixing member 6 is screwed into the female threaded portion 44*b* of the second annular recessed portion 44 formed in the cylindrical portion 42 of the shell 4. Upon this, the annular convex portion 62 of the fixing member 6 presses the outer surface (i.e. lower surface) of the mounting portion 51 of the oil port member 5, whereby the outer peripheral portion of the mounting portion 51 of the oil port member 5 can be fixed in a manner sandwiched between the first annular stepped portion 45 of the shell 4 and the annular convex portion 62 of the fix member 6. Further, since the axial movement of the oil port member 5 with respect to the shell 4 is restricted by the first annular stepped portion 45, mounting the fixing member 6 to the shell 4, specifically to the second annular recessed portion 44, causes the oil port member 5 to be fixed in a predetermined position to the shell 4.

With the arrangement above, since the outer diameter D1 of the bellows main body 31 is smaller than the inner diameter d4 of the opening portion 4*a* of the shell 4 (D1<d4; see FIG. 1) and the outer diameter D3 of the mounting portion 51 of the oil port member 5 is greater than the outer diameter D1 of the bellows main body 31 (D1<D3; see FIG. 1), when the bellows main body 31 welded and fixed to the oil port member 5 is inserted through the opening portion 4*a* of the shell 4 and the oil port member 5 is fixed detachably to the shell 4 with the fixing member 6, the bellows main body 31 and the oil port member 5 can be mounted to the shell 4, and further the bellows main body 31 and the oil port member 5 can be drawn and detached together through the opening portion 4*a* of the shell 4 for easier maintenance of the bellows main body 31. In addition, the annular seal portion S2 is formed by the O-ring 52 interposed between the outer peripheral surface 51*a* of the mounting portion 51 of the oil port member 5 and the first annular recessed portion 43 of the shell 4, which can prevent liquid within the liquid chamber 8 of the housing 2 from leaking out.

Specifically, as in the related art, for example, in the case of a metal bellows-type accumulator 1 in which the outer peripheral surface 51*a* of the mounting portion 51 of the oil port member 5 is welded and fixed to the second annular recessed portion 44 formed in the cylindrical portion 42 of the shell 4 to seal the opening portion 4*a* of the shell 4, it is necessary to precisely weld the shell 4 and the oil port member 5 in the circumferential direction to ensure a sealing performance of the housing 2. In this case, the shell 4 and the oil port member 5 are welded and therefore cannot be separated, which makes it difficult to perform the operation of maintenance such as replacement of the bellows main body 31.

On the other hand, the first embodiment of the accumulator 1 according to the present invention is configured such that the annular seal portion 92 is formed by the O-ring 52 interposed between the outer peripheral surface 51*a* of the mounting portion 51 of the oil port member 5 and the first annular recessed portion 43 of the shell 4, which can prevent liquid within the liquid chamber 8 of the housing 2 from leaking out, whereby the housing 2 can have a high sealing performance without welding the shell 4 and the oil port member 5. Moreover, since the male screw portion 61*b* formed on the mounting portion 61 of the fixing member 6 is screwed into the female threaded portion 44*b* of the second annular recessed portion 44 of the shell 4 as described above, it is possible to maintain the state where the opening portion 4*a* of the shell 4 is sealed by the oil port member 5 and thereby to fix the oil port member 5 to the shell 4 with the separate fixing member 6 that is easily attachable and detachable to/from the shell 4, whereby the operation of fixation/separation of the oil port member 5 to/from the shell 4 can be simplified for easier maintenance of the bellows main body 31.

Also, since the fixation of the oil port member 5 to the shell 4 is achieved through screw-fixation of the fixing member 6, which is separate from the oil port member 5, the oil port member 5 cannot be rotated together with the fixing member 6 during screw-fixation of the fixing member 6 to the shell 4, whereby it is possible to prevent the O-ring 52 from being rubbed and therefore abraded between the outer peripheral surface 51*a* of the mounting portion 51 of the oil port member 5 and the first annular recessed portion 43 of the shell 4.

Further, since the fixation of the oil port member 5 with the bellows main body 31 welded and fixed thereto to the shell 4 is achieved not through welding but through screw-fixation, the oil port member 5 cannot be thermally deformed during fixation to the shell 4 and the residual stress on the oil port member 5 after the fixation can be reduced.

Also, when the bellows main body 31 and the oil port member 5 are detached from the opening portion 4*a* of the shell 4, the gas plug 41 in the gas enclosure port 40 of the shell 4 is first loosened so that the high-pressure gas within the gas chamber 7 is discharged and thereby the gas pressure within the gas chamber 7 is reduced. In this state, the bellows main body 31 is applied with no stress from the high-pressure gas and can be detached safely. Further, the gas enclosure port 40 can enclose high-pressure gas injected in the gas chamber 7 through follow-up screw-fixation of the gas plug 41 for easier maintenance of the accumulator 1.

Also, since the movement of the oil port member 5 in the axial direction (i.e. the direction of insertion) can be restricted by bringing the interior surface (i.e. the upper surface) in the outer peripheral portion of the mounting portion 51 of the oil port member 5 into contact with the first annular stepped portion 45 formed in the cylindrical portion 42 of the shell 4, the oil port member 5 can be positioned easily with respect to the shell 4.

Also, through screw-fixation of the fixing member 6 to the shell 4, the outer peripheral portion of the mounting portion 51 of the oil port member 5 can be fixed in a manner sandwiched between the first annular stepped portion 45 of the shell 4 and the annular convex portion 62 of the fixing member 6, whereby the oil port member 5 can be prevented from being rotated with respect to the shell 4. Further, through screw-fixation of the fixing member 6 to the shell 4, an axially pressing stress (toward the first annular stepped portion 45) can act on the outer peripheral portion of the mounting portion 51 of the oil port member 5, whereby the oil port member 5 can be prevented from being rotated with respect to the shell 4 during use of the accumulator 1.

Also, since the fixing member 6 has an annular configuration, through screw-fixation of the fixing member 6 to the shell 4, an axially pressing stress can act evenly on the outer peripheral portion of the mounting portion 51 of the oil port member 5. The total weight can also be reduced compared to a disk-shaped configuration.

Also, in the inner peripheral surface 42*a* of the cylindrical portion 42 of the shell 4, the second annular stepped portion 46 is formed between the first annular recessed portion 43 and the second annular recessed portion 44, whereby the axial position of the annular convex portion 62 of the fixing member 6, which is formed to have an outside diameter D3 approximately equal to the inside diameter d3 of the first annular recessed portion 43, cannot be restricted and therefore the oil port member 5 can be fixed reliably in an adequate axial position to the shell 4.

In addition, the male screw portion 61*b* formed on the outer peripheral surface 61*a* of the mounting portion 61 of the fixing member 6 is screwed into the female threaded portion 44*b* formed in the second annular recessed portion 44 of the inner peripheral surface 42*a* of the cylindrical portion 42 of the shell 4, which allows the fixing member 6 to be arranged on the radially inside of the shell 4, whereby the structure of fixation of the oil port member 5 to the shell 4 can be compacted.

It is noted that the oil port member 5 may be key-fitted into the shell 4 (e.g. a recessed portion serving as an axially extending key groove is provided in the first annular stepped portion 45 of the shell 4, into which a projection is fitted serving as an axially extending key on the outer peripheral portion of the oil port member 5). In this case, since the key-fitting restricts the relative rotation of the oil port member 5 to the shell 4, the oil port member 5 is rotated together during screw-fixation of the fixing member 6 to the shell 4, which can prevent the O-ring 52 from being rotated to ensure a sealing performance.

Second Embodiment

The second embodiment of the accumulator according to the present invention will next be described with reference to FIG. 4. It is noted that components identical to those shown in the above-described embodiment are designated by the same reference signs to omit the redundant description thereof.

Figure 4:
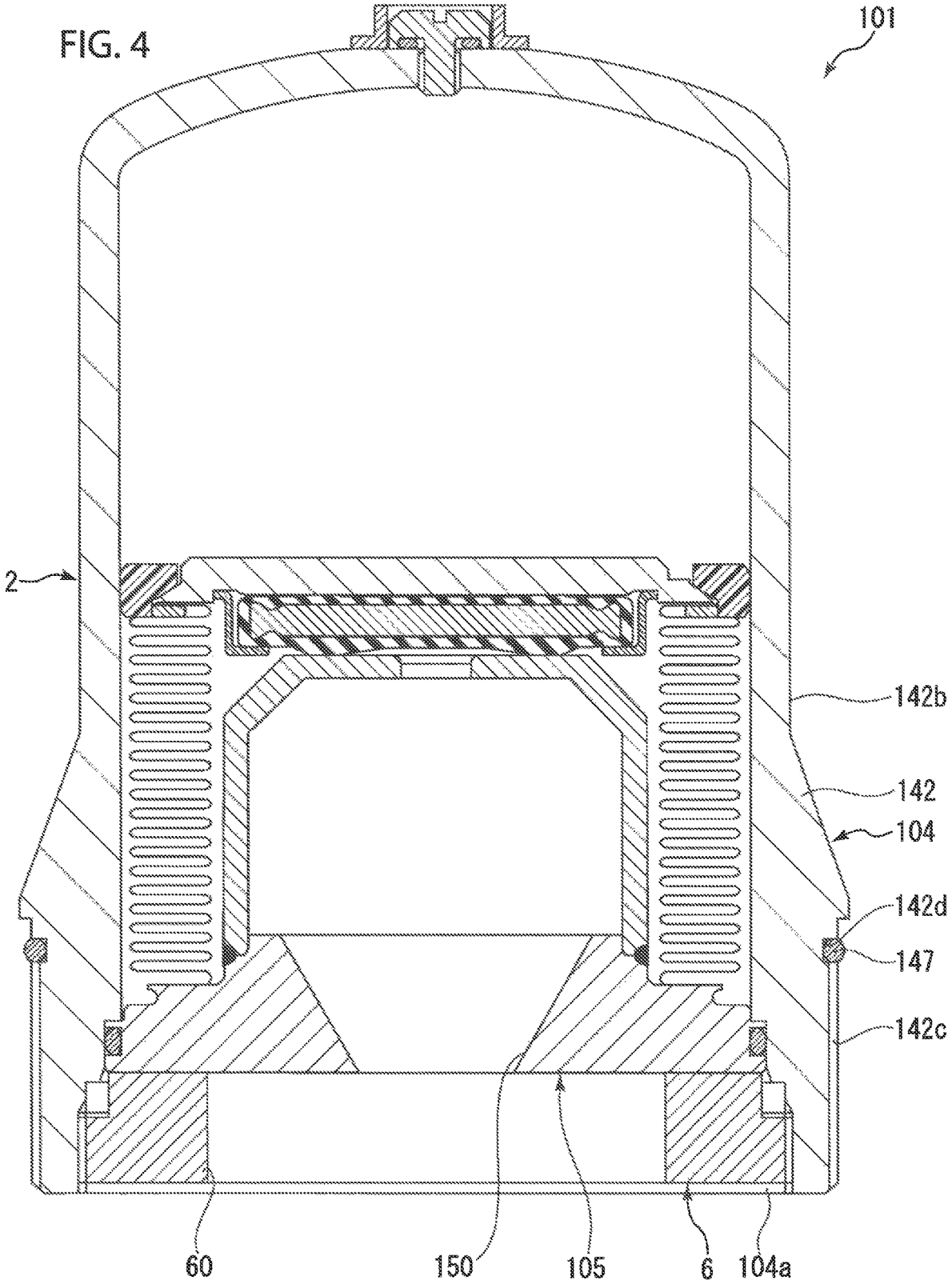
FIG. 4 is a cross-sectional view snowing a second embodiment of the accumulator according to the present invention.

As shown in FIG. 4, the accumulator 101 of the second embodiment is arranged such that a male screw portion 142*c* is formed closer to the opening portion 104*a* of the outer peripheral surface 142*b* of the cylindrical portion 142 of the shell 104. An O-ring 147 composed of a rubber elastic body is mounted in an annular groove portion 142*d* formed in the outer peripheral surface 142*b* of the cylindrical portion 142 of the shell 104 and recessed radially inward.

The oil port member 105 is provided with a fluid outflow and inflow path 150 penetrating in the axial direction.

With the arrangement above, the accumulator 101 can be connected detachably to a chassis provided with pressure piping not shown by threading the male screw portion 142*c* on the shell 104 into a female threaded portion formed in the chassis. Also, the O-ring 147 can be interposed between the chassis and the outer peripheral surface 142*b* of the cylindrical portion 142 of shell 104 to connect the accumulator 101 to the chassis in a tightly closed manner. Further, in the state where the accumulator 101 is connected to the chassis in a tightly closed manner, liquid within the pressure piping can flow out of and into the housing 2 through the through hole 60 in the fixing member 6 and the fluid outflow and inflow path 150 in the oil port member 105.

Third Embodiment

The third embodiment of the accumulator according to the present invention will next be described with reference to FIG. 5. It is noted that components identical to those shown in the above-described embodiments are designated by the same reference signs to omit the redundant description thereof.

Figure 5:
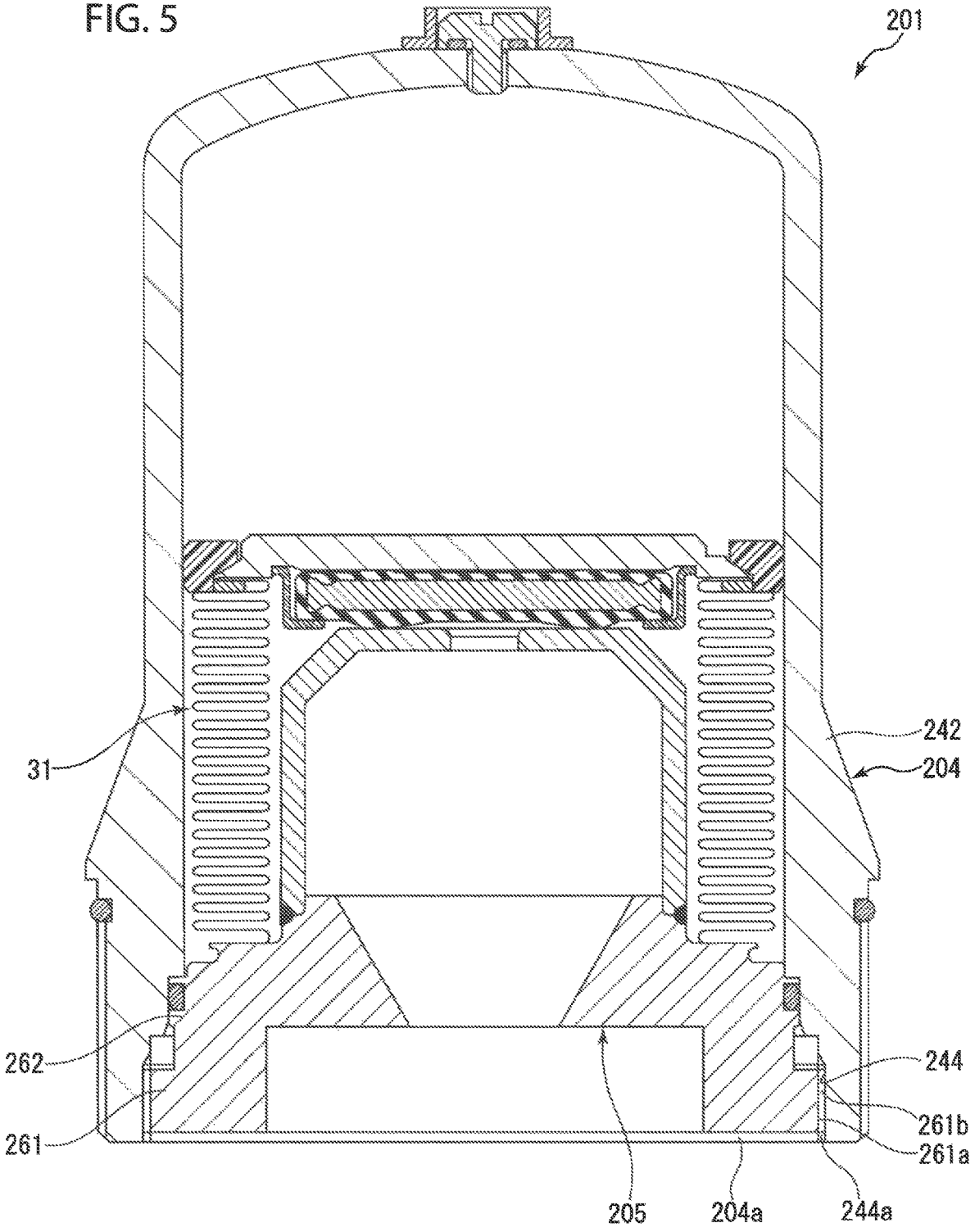
FIG. 5 is a cross-sectional view showing a third embodiment of the accumulator according to the present invention.

As shown in FIG. 5, the accumulator 201 of the second embodiment is arranged such that an annular convex portion 261 is provided protruding from the outer surface (lower surface) of the mounting portion 251 of the oil port member 205 toward the opening portion 204*a* of the shell 204. The annular convex portion 261 is formed to have an outer diameter approximately equal to the inner diameter of the second annular recessed portion 244 formed in the cylindrical portion 242 of the shell 204, on the outer peripheral surface 261*a* of which a male screw portion 261*b* is formed. That is, the oil port member 5 and the fixing member 6 in the above-mentioned first embodiment are formed integrally.

With the arrangement above, the accumulator 201 can maintain the state where the opening portion 204*a* of the shell 204 is sealed by the oil port member 205 by screwing the male screw portion 261*b* formed on the annular convex portion 261 of the oil port member 205 into the female threaded portion 244*a* formed in the second annular recessed portion 244 of the shell 204, which requires no additional fixing member to fix the oil port member 205 to the shell 204, whereby the operation of fixation/separation of the oil port member 205 to/from the shell 204 can be simplified for easier maintenance of the bellows main body 31.

Fourth Embodiment

The forth embodiment of the accumulator according to the present invention will next be described with reference to FIG. 6. It is noted that components identical to those shown in the above-described embodiments are designated by the same reference signs to omit the redundant description thereof.

Figure 6:
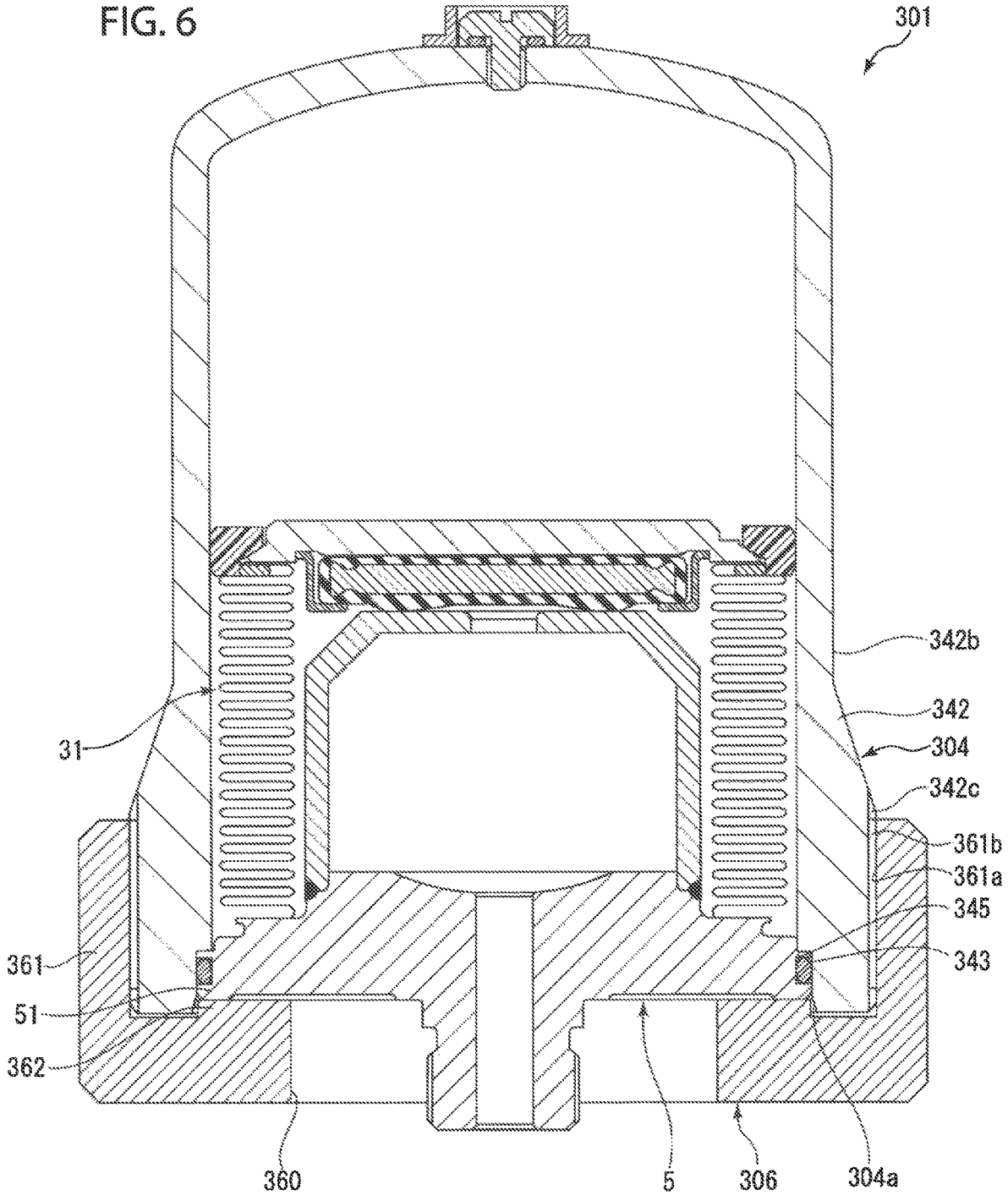
FIG. 6 is a cross-sectional view showing a fourth embodiment of the accumulator according to the present invention.

As shown in FIG. 6, the accumulator 301 of the fourth embodiment is arranged such that a female threaded portion 342*c* is formed closer to the opening portion 304*a* of the outer peripheral surface 342*b* of the cylindrical portion 342 of the shell 304.

The fixing member 306 has an upward opened cup shape with the mounting portion 361 extending out to cover the opening portion 304*a* of the shell 304 on the radially outside, and is provided with a through hole 360 penetrating axially on the radially inside to have an annular shape. Also, the mounting portion 361 is formed to have an inner diameter approximately equal to the outer diameter of the female threaded portion 342*c* formed in the outer peripheral surface 342*b* of the cylindrical portion 342 of the shell 304, and a male screw portion 361*b* is formed on the inner peripheral surface 361*a* of the mounting portion 361.

The upper surface of the fixing member 306 is also formed with an annular convex portion 362 protruding upward (toward the oil port member 5) from the mounting portion 361 and having an outer diameter approximately equal to the inner diameter of the first annular recessed portion 343 formed in the cylindrical portion 342 of the shell 304.

With the arrangement above, the accumulator 301 can maintain the state where the opening portion 304*a* of the shell 304 is sealed by the oil port member 5 by screwing the male screw portion 361*b* formed on the inner peripheral surface 361*a* of the mounting portion 361 of the fixing member 306 into the female threaded portion 342*c* formed in the outer peripheral surface 342*b* of the cylindrical portion 342 of the shell 304, and it is also possible to fix the oil port member 5 to the shell 304 with the separate fixing member 306 that is easily attachable and detachable to/from the shell 304, whereby the operation of fixation/separation of the oil port member 5 to/from the shell 304 can be simplified for easier maintenance of the bellows main body 31.

In addition, since the outer peripheral portion of the mounting portion 51 of the oil port member 5 can be fixed in a manner sandwiched between the first annular stepped portion 345 of the shell 304 and the annular convex portion 362 of the fixing member 306, whereby the oil port member 5 can be fixed in a predetermined position to the shell 304 and prevented from being rotated with respect to the shell 304.

Fifth Embodiment

The fifth embodiment of the accumulator according to the present invention will next be described with reference to FIG. 7. It is noted that components identical to those shown in the above-described embodiments are designated by the same reference signs to omit the redundant description thereof.

Figure 7:
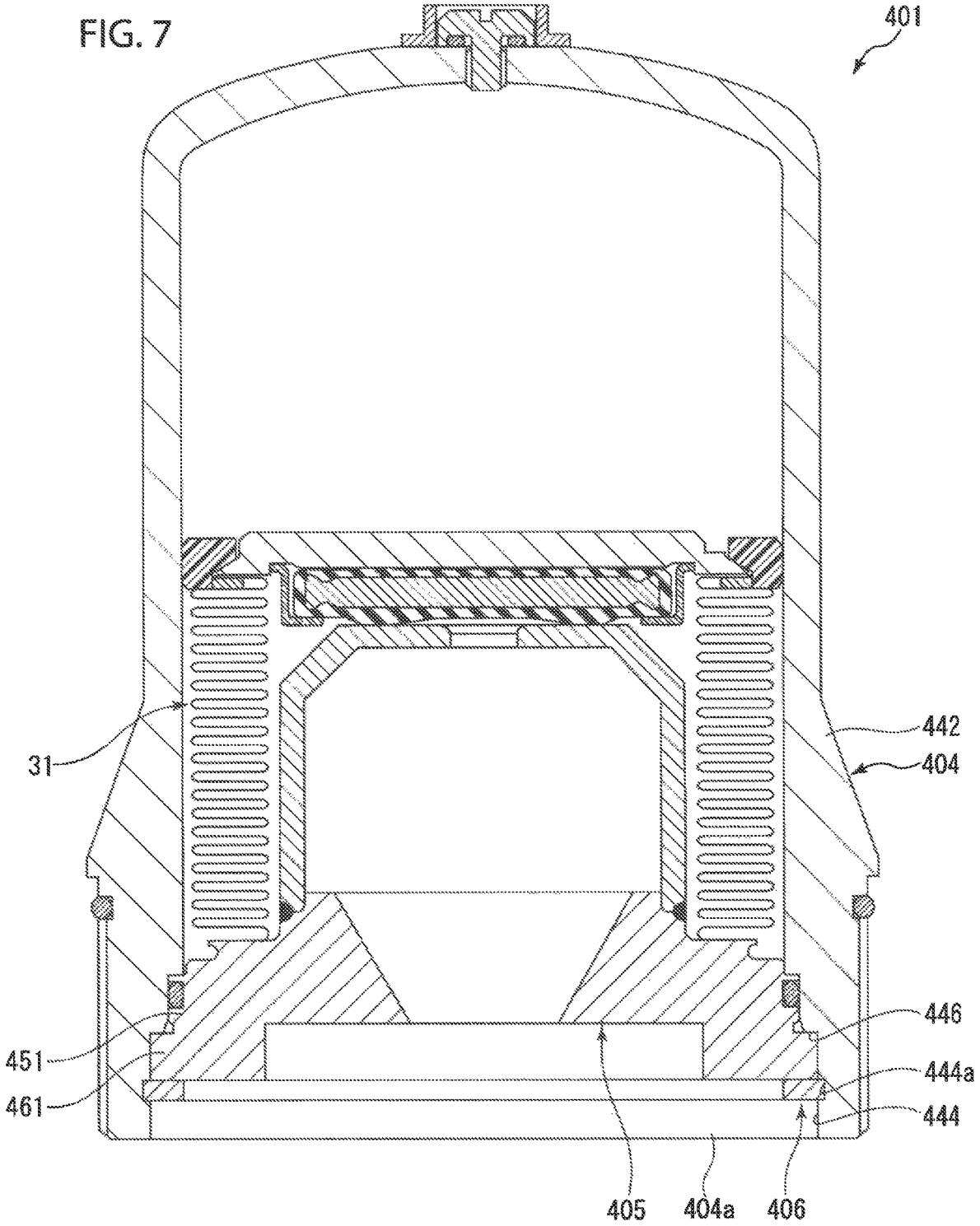
FIG. 7 is a cross-sectional view showing a fifth embodiment of the accumulator according to the present invention.

As shown in FIG. 7, the accumulator 401 of the fifth embodiment is arranged such that an annular groove portion 444*a* recessed radially outward is formed in the second annular recessed portion 444 of the cylindrical portion 442 of the shell 404.

The oil port member 405 is provided with a protrusion 461 protruding from the outer surface (i.e. the lower surface) of the mounting portion 451 toward the opening portion 404*a* of the shell 404. The protrusion 461 is formed to have an outer diameter approximately equal to the inner diameter of the second annular recessed portion 444 formed in the cylindrical portion 442 of the shell 404 and also to be fitted into the second annular recessed portion 444 in the state where the interior surface (i.e. the upper surface) is in contact with the second annular stepped portion 446 formed in the cylindrical portion 442 of the shell 404.

The fixing member 406 has an approximately C-shaped stop ring form and is formed to have an outer diameter greater than the inner diameter of the second annular recessed portion 444 formed in the shell 404 and approximately equal to the inner diameter of the groove portion 444*a* formed in the second annular recessed portion 444 of the shell 404. It is noted that the fixing member 406 is not limited to have an approximately C shape as long as having a stop ring form.

With the arrangement above, the accumulator 401 can maintain the state where the opening portion 404*a* of the shell 404 is sealed by the oil port member 405 by fitting the fixing member 406 of a stop ring form into the groove portion 444*a* formed in the second annular recessed portion 444 of the shell 404, and it is also possible to fix the oil port member 405 to the shell 404 with the separate fixing member 406 that is easily attachable and detachable to/from the shell 404, whereby the operation of fixation/separation of the oil port member 405 to/from the shell 404 can be simplified for easier maintenance of the bellows main body 31.

In addition, since the outer peripheral portion of the protrusion 461 of the oil port member 405 can be fixed in a manner sandwiched between the second annular stepped portion 446 of the shell 404 and the fixing member 406, whereby the oil port member 405 can be fixed in a predetermined position to the shell 404 and prevented from being rotated with respect to the shell 404.

While the examples of the present invention have heretofore been described with reference to the accompanying drawings, the specific configuration is not intended to be limited to these embodiments, and modifications and additions within the scope not departing from the spirit of the present invention will also be encompassed by the invention.

Figure 8:
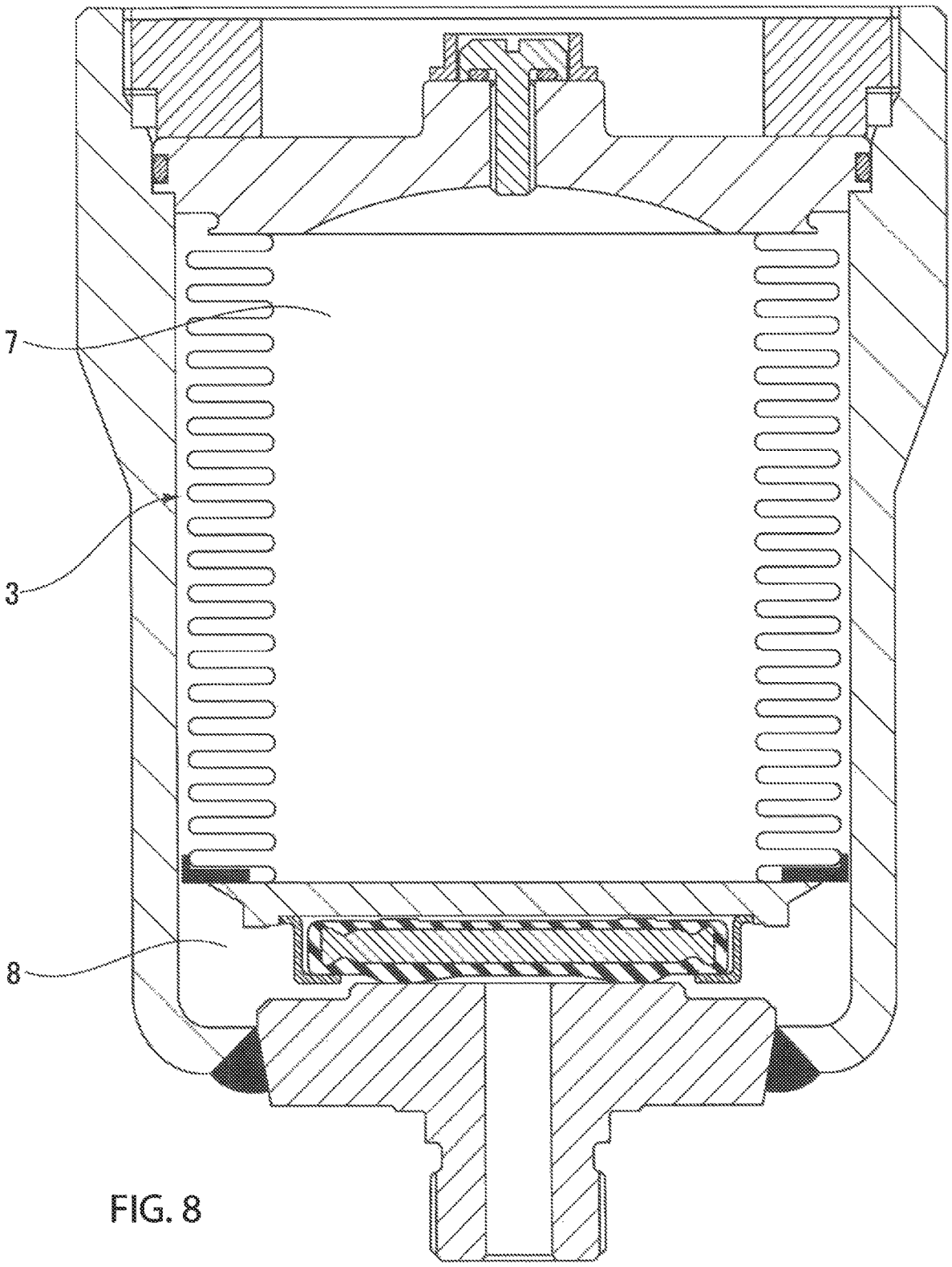
FIG. 8 is a cross-sectional view of an inward gas-type accumulator which is shown as an embodiment of the accumulator according to the present invention and in which a liquid chamber is set on the outside of a bellows, while a gas chamber is set on the inside of the bellows.

For example, in the above-described embodiments, the accumulators 1, 101, 201, 301, 401 are each described as an outward gas-type accumulator in which the gas chamber 7 is set on the outside of the bellows 3, while the liquid chamber 8 is set on the inside of the bellows 3 but, without limiting thereto, may be, for example, an inward gas-type accumulator in which the liquid chamber 8 is set on the outside of the bellows 3, while the gas chamber 7 is set on the inside of the bellows 3 (see FIG. 8).

Also, in the above-described embodiments, the housing 2 is described that the opening portion 4*a*, 104*a*, 204*a*, 304*a*, 404*a* of the bottomed cylindrical shell 4, 104, 204, 304, 404 is sealed by the oil port member 5, 105, 405 to be fixed using the fixing member 6, 306, 406 or the oil port member 205 configured integrally with the fixing member but, without limiting thereto, may be arranged such that opening portions at the upper and lower ends of a cylindrical shell opened at the both ends are sealed, respectively, by an oil port member to be fixed using fixing means and a gas enclosure member.

Although the embodiments have been described as an aspect in which the O-ring 52 is mounted in the groove portion 51*b* formed in the oil port member 5, 105, 205, 405, the O-ring may be mounted in a groove portion formed in the inner peripheral surface of the cylindrical portion of the shell. Further, the O-ring is not limited to be interposed between the outer peripheral surface of the mounting portion of the oil port member and the first annular recessed portion of the shell, but may be arranged freely as long as capable of ensuring a sealing performance between the shell and the oil port member. For example, the O-ring may be mounted in the fixing member.

Moreover, the annular seal member is not limited to an O-ring, but may be a seal member of another type such as packing.

REFERENCE SIGNS LIST

1 Accumulator
2 Housing
3 Bellows
4 Shell
4*a* Opening portion
5 Oil port member (base body)
6 Fixing member
7 Gas chamber
8 Liquid chamber

31 Bellows main body
31*a* Fixed end (one end portion of the bellows)
42 Cylindrical portion
42*a* Inner peripheral surface
43 First annular recessed portion
43*a* Inner peripheral surface
44 Second annular recessed portion
44*a* Inner peripheral surface
44*b* Female threaded portion
45 First annular stepped portion (restrictive stepped portion)
46 Second annular stepped portion
50 Fluid outflow and inflow path (through hole)
51 Mounting portion
51*a* Outer peripheral surface
51*b* Groove portion
52 O-ring (annular seal member)
54 Second annular convex portion
54*a* Welded portion
61 Mounting portion
61*a* Outer peripheral surface
61*b* Male screw portion
62 Annular convex portion
S1, S2 Seal portion

The invention claimed is:

1. An accumulator comprising:
a housing having a shell provided with an opening portion and a base body formed in a disk shape; and
a bellows made of metal and having an outer diameter smaller than an inner diameter of the opening portion,
one end portion of the bellows being welded and fixed to the base body, an interior of the housing being partitioned into an inner space and an outer space of the bellows in a tightly closed manner, wherein
the base body has an outer diameter greater than the outer diameter of the bellows, and the base body is fixed detachably to the shell, and
an inner peripheral surface of the shell is provided with a restrictive stepped portion with which an outer peripheral portion of the base body is in contact.

2. The accumulator according to claim 1, further comprising:
an annular seal member provided between the outer peripheral portion of the base body and the inner peripheral surface of the shell; and
a fixing member formed as a discrete body separate from the base body and configured to fix the base body to the shell.

3. The accumulator according to claim 2, wherein the fixing member has an outer peripheral portion provided with a male screw portion screwed into a female threaded portion provided in the inner peripheral surface of the shell.

4. The accumulator according to claim 3, wherein the fixing member is annular.

5. The accumulator according to claim 2, wherein the fixing member is annular.

6. The accumulator according to claim 1, wherein the base body is provided with a through hole in communication with the inner space of the bellows.

7. The accumulator according to claim 1, wherein the base body is key-fitted into the shell.

8. An accumulator comprising:
a housing having a shell provided with an opening portion and a base body formed in a disk shape; and
a bellows made of metal and having an outer diameter smaller than an inner diameter of the opening portion,
one end portion of the bellows being welded and fixed to the base body, an interior of the housing being partitioned into an inner space and an outer space of the bellows in a tightly closed manner, wherein
the base body has an outer diameter greater than the outer diameter of the bellows, and the base body is fixed detachably to the shell, and
the accumulator further comprises:
an annular seal member provided between the outer peripheral portion of the base body and the inner peripheral surface of the shell; and
a fixing member formed as a discrete body separate from the base body and configured to fix the base body to the shell.

9. The accumulator according to claim 8, wherein the fixing member has an outer peripheral portion provided with a male screw portion screwed into a female threaded portion provided in the inner peripheral surface of the shell.

10. The accumulator according to claim 9, wherein the fixing member is annular.

11. The accumulator according to claim 9, wherein the base body is provided with a through hole in communication with the inner space of the bellows.

12. The accumulator according to claim 9, wherein the base body is key-fitted into the shell.

13. The accumulator according to claim 8, wherein the fixing member is annular.

14. The accumulator according to claim 13, wherein the base body is provided with a through hole in communication with the inner space of the bellows.

15. The accumulator according to claim 13, wherein the base body is key-fitted into the shell.

16. The accumulator according to claim 8, wherein the base body is provided with a through hole in communication with the inner space of the bellows.

17. The accumulator according to claim 8, wherein the base body is key-fitted into the shell.

* * * * *